United States Patent [19]

Arrendiell et al.

[11] Patent Number: 4,742,429

[45] Date of Patent: May 3, 1988

[54] BATHROOM ELECTRICAL APPLIANCE CADDY

[76] Inventors: Robert W. Arrendiell; Gwendolyn G. Ellis, both of 280 Sugarberry Cir., Houston, Tex. 77024

[21] Appl. No.: 942,270

[22] Filed: Dec. 16, 1986

[51] Int. Cl.[4] ..... H05K 7/14

[52] U.S. Cl. ..... 361/391; 200/61.62; 361/331

[58] Field of Search ..... 307/61.74, 150, 141.4; 312/223; 361/338, 331, 390–391, 428; 200/61.74, 61.62

[56] References Cited

U.S. PATENT DOCUMENTS

| | | | |
|---|---|---|---|
| 1,775,654 | 9/1930 | Myers | 312/223 |
| 2,173,101 | 9/1939 | Fiedler | 361/338 |
| 2,370,861 | 3/1945 | Jakeway . | |
| 2,486,764 | 11/1949 | Singer | 361/391 |
| 3,013,852 | 12/1961 | Rockola . | |
| 3,088,054 | 4/1963 | Meyer | 361/338 |
| 3,546,659 | 12/1970 | Powers | 361/391 |
| 3,673,592 | 6/1972 | Berry et al. . | |
| 3,716,284 | 2/1973 | Vogt . | |
| 3,717,805 | 2/1973 | Graedinger et al. | 361/338 |
| 3,744,869 | 7/1973 | Anderson et al. . | |
| 3,949,902 | 4/1976 | Thompson . | |
| 4,260,208 | 4/1981 | Lun Ho et al. . | |
| 4,370,007 | 1/1983 | Fler . | |
| 4,436,352 | 3/1984 | Okada et al. . | |
| 4,529,852 | 7/1985 | Lewandowski | 200/61.62 |
| 4,582,372 | 4/1986 | Cooper . | |
| 4,588,901 | 5/1986 | MacLay et al. | 307/141.4 |

FOREIGN PATENT DOCUMENTS

| | | | |
|---|---|---|---|
| 0567405 | 2/1945 | United Kingdom | 361/338 |
| 1022251 | 6/1983 | U.S.S.R. | 361/428 |

*Primary Examiner*—A. D. Pellinen
*Assistant Examiner*—Greg Thompson
*Attorney, Agent, or Firm*—Vaden, Eickenroht, Thompson & Boulware

[57] ABSTRACT

An appliance caddy is conveniently mounted on a platform with sidewalls via track-and-roller systems, the platform readily mounted inside a bathroom cabinet and underneath a lavatory in a space previously considered to be of limited utility. The caddy includes one or more connectors or electrical plugs and an electrical cord for providing electricity to the plugs from a wall plug either inside or outside the cabinet. The caddy is conveniently shaped to organize and hold larger and smaller appliances and can include a safety switch for insuring that all appliances are turned off when they are no longer being used.

8 Claims, 1 Drawing Sheet

BATHROOM ELECTRICAL APPLIANCE CADDY

BACKGROUND OF THE INVENTION

1. Field of the Invention

This invention pertains to apparatus for accommodating electrical appliances used in the bathroom and more particularly to apparatus for storing such appliances in the cabinet underneath a bathroom lavatory for allowing their use in a convenient manner.

2. Description of the Prior Art

There are many bulky and general unsightly electrical appliances commonly in use in the bathroom. These include electric shavers, electric curler sets, hair blow dryers, contact lens oven-cleaners, electric tooth brushes, electrical water jet equipment for cleaning teeth and the like. Generally, such devices are left on the countertop when not in use (although giving an unslightly appearance), put away in a suitable cabinet or put away in a convenient drawer. When put away, all of these devices are unplugged from the source of electrical power even though most also have switches for turning them on and off. When left on the countertop, sometimes they are left plugged in and sometimes not, generally depending on the plug capacity.

Bathroom cabinets include those that are located conveniently for storing such things as towels and toilet articles and those that are located underneath the lavatory, an inconvenient space for storing the above items, but possibly suitable for storing cleaning items or maybe an out-of-sight waste receptacle. Drawers are also usual in the bathroom, but there are no full size drawers underneath the lavatory because of the presence of the drain pipe and even the inlet pipes to the lavatory and the bottom of the lavatory itself. These things occupy a part of the space underneath the lavatory and make it impossible to install full size drawers in the same location.

There are auxiliary cabinets available that are free-standing for all manner of purposes. In addition, there are cabinets that are equipped with a shelf that slides out of the cabinet on rollers means attached to the cabinet and the sides of the shelf. Typically, television sets are mounted in this fashion to permit the television set to be pulled forward from the confines of the closed cabinet and to then be pivoted on its support shelf for convenient viewing. The roller or sliding means just descirbed is generally a pre-installed condition of the cabinet or, if incorporated into an existing cabinet, requires the experience of a skilled craftsman. Because of this, custom installations of the kind described are not common. There is nothing available in the marketplace that conveniently utilizes the slidable shelf technology for use in the bathroom for accommodating the electrical appliances above described, especially in conjunction with the "dead space" underneath the bathroom lavatory.

Therefore, it is a feature of the present invention to provide an improved apparatus for accommodating electrical appliances generally found in the bathroom and to permit their ready storage without requiring disconnecting them from their power sources.

It is another feature of the present invention to provide an improved apparatus of the type identified above that can be quickly and conveniently installed in the cabinet located underneath a bathroom lavatory.

It is yet another feature of the present invention to provide an improved apparatus of the type identified above that additionally includes safety means for ensuring that the accommodated electrical appliances do not remain "on" for an extended period of time after use.

SUMMARY OF THE INVENTION

The apparatus in a preferred embodiment of the present invention includes a separate base and sliding support assembly. The base includes mounted thereon one portion of a roller-and-track system and mounting holes to accommodate two or more wood screws for securing the base in the proper place within the cabinet. The sliding support assembly includes mounted thereon the other portion of the roller-and-track system so that it can be slid or rolled back and forth with respect to the base. The support assembly generally includes a lower shelf, an upper shelf and electrical outlet plugs so that the appliances carried by the assembly can be conveniently powered. The upper shelf is at a convenient height to allow the appliances thereon not to encounter the drain pipe attached to the lavatory. In addition, the upper shelf is recessed in the front, but deep enough to carry such things as two curler sets, and one or two small receptacles for the curler pins or the like. The base and support assembly are sized so as not to interfere with the water and drain pipes attached to the lavatory basin.

The bottom shelf includes an area for the outlet plugs, one for each appliance, and enough space for the appliance cords to be coiled. Suitable holes in the upper shelf can be provided to permit the ends of cords from the appliances on this shelf to pass therethrough. A hair dryer and other smaller appliances can be conveniently carried on the front of the lower shelf, as well. An electrical connection to the service power source can be included underneath the lavatory and plugged into the outlet plugs on the support assembly. Alternatively, an extension cord can provide power when the support assembly is pulled out. A cleat arrangement on a recessed side of the support assembly provides a storage location for the extension cord.

A spring-loaded safety switch on the assembly operated by the closing of the door or by the pushing of the assembly to its storage position provides one way to ensure that the appliances are not left on after use. Alternatively, such a switch can be attached to a timer that turns off the power at a later time after the support assembly has been returned to its storage condition.

BRIEF DESCRIPTION OF THE DRAWINGS

So that the manner in which the above-recited features, advantages and objects of the invention, as well as others which will become apparent, are attained and can be understood in detail, more particular description of the invention briefly summarized above may be had by reference to the exemplary embodiment thereof which is illustrated in the drawings, which drawings form a part of this specification. It is to be noted, however, that the appended drawings illustrate only a typical preferred embodiment of the invention and are therefore not to be considered limiting of its scope as the invention may admit to other equally effective embodiments.

IN THE DRAWINGS

Figure 1:
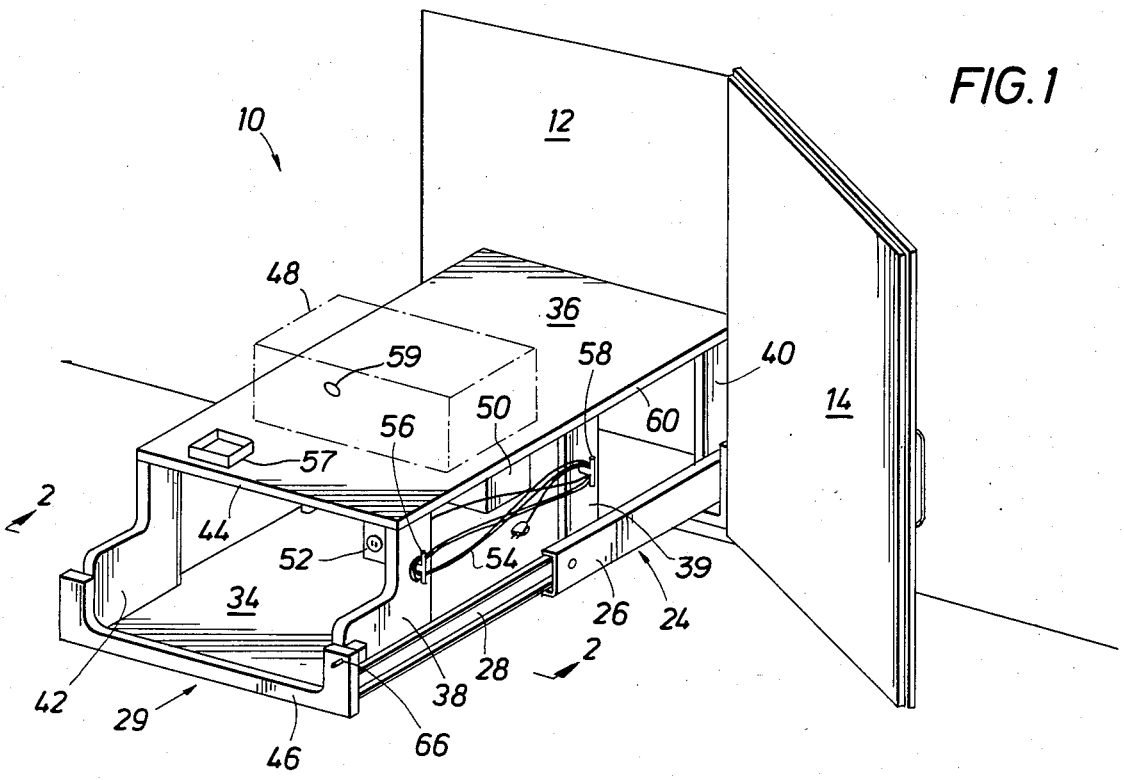

FIG. 1 is an oblique view of a preferred embodiment of the invention installed in a bathroom cabinet underneath the lavatory.

Figure 2:
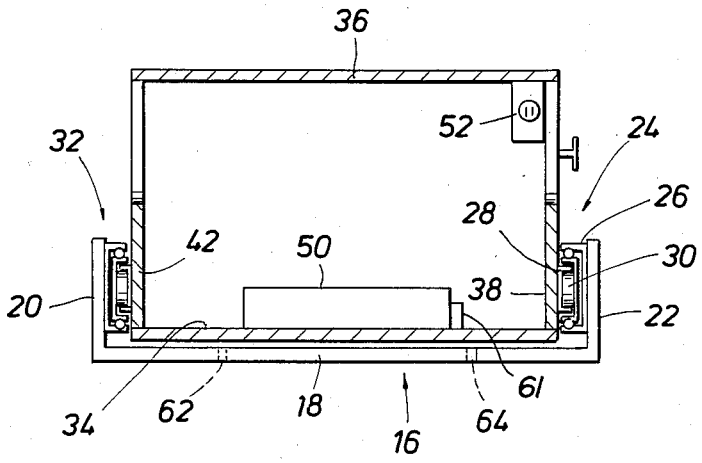

FIG. 2 is a vertical section of the embodiment of the invention shown in FIG. 1 taken at view 2—2 illustrating the relationship of the platform, track-and-roller system and the shelving system of the illustrated embodiment.

Figure 3:
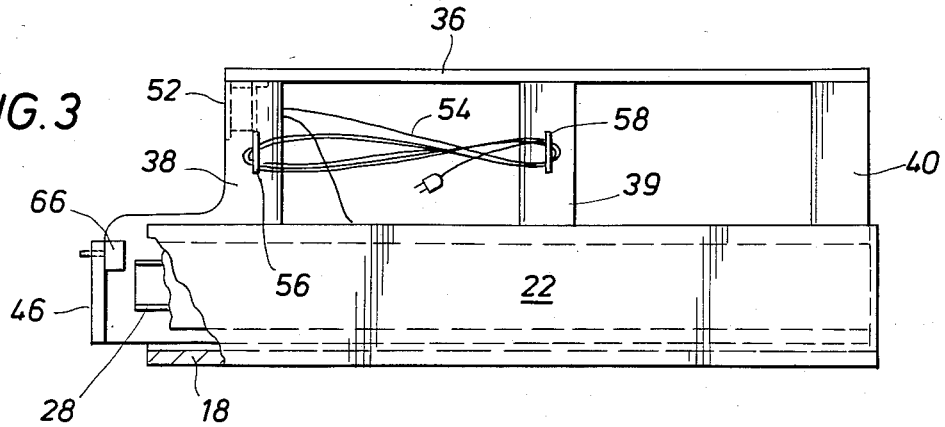

FIG. 3 is a side view of the embodiment of the invention shown in FIGS. 1 and 2 illustrating in particular the relationship of the platform, the track-and-roller system and the shelving system.

DESCRIPTION OF PREFERRED EMBODIMENTS

Referring to the drawings and first to FIG. 1, electrical appliance-accommodating apparatus or caddy 10 is shown in a position of use as it extends from bathroom cabinet 12, door 14 thereof being shown in its open position. Base member 16 includes a horizontal platform 18 attached to upwardly extending vertical sidewalls 20 and 22. Platform 18 is sized so as to fit the depth dimension of cabinet 12 to terminate sufficiently behind the front opening of the cabinet to permit door 14 to shut when apparatus 10 is in its stored condition. The width dimension of apparatus 10 permits entry into the width of the cabinet opening.

A track-and-roller system 24 is provided to permit apparatus 10 to be extended from cabinet 12 and be pushed back into the cabinet when not in use. The system includes a U-channel track 26 mounted to sidewall 22. A cooperatively operating roller track 28 is attached to sliding support assembly 29. A plurality of rollers 30 are located within track 26 and cooperate with track 28 to permit assembly 29 to be completely drawn forward as shown in FIG. 1. In similar fashion, a track-and-roller system 32 is attached between sidewall 20 and sliding support assembly 29.

Although track-and-roller systems 24 and 32 of a well-known type have been described above, other track-and-roller systems are also well known in the art and may be used instead, if desired.

Sliding support assembly 29 includes a lower shelf 34 and an upper shelf 36, the upper shelf being supported by a plurality of vertical supports 38, 39 and 40 on the right side of the assembly and similar supports located on the left. One of these supports is front support 42, but the other supports are hidden from view in FIG. 1. Upper shelf 36 is preferable not as deep as shelf 34, its back edge being in alignment with shelf 34. Support 38 and similarly shaped support 42 are each generally L-shaped so as to provide front edge 44 of shelf 36 to be recessed from the front edge of the assembly to thereby permit an appliance to be accommodated on the lower shelf in front of the upper shelf. A generally U-shaped front panel 46 is attached to the front edge of supports 38 and 42 to complete the framing of the assembly.

It may be seen that one or more large electrical appliances, such as hair curler sets, may be placed on upper shelf 36. One such large appliance 48 is shown in dotted lines in FIG. 1. One or more small, cup-shaped receptacles 57 can also be provided on upper shelf 36 for holding small items. Conveniently, one or more holes 59 may be included in shelf 36 to permit electrical cords to pass therethrough to be plugged into a connector box 50 located on lower shelf 34 underneath upper shelf 36. Connector box 50 includes a plurality of connectors for accommodating to a plurality of appliance plugs from the appliances carried by caddy apparatus 10.

A plug 52 may also be conveniently located underneath shelf 36 and inside support 38. Smaller electrical appliances may be located on the front portion of lower shelf 34 and plugged into a plug 52. Plug 52, being readily accessible just under edge 44 of upper shelf 36, permits the appliances located in this position to be more easily unplugged and removed from the assembly than larger appliances 48, which one would not ordinarily remove.

Electricity is provided to connector box 50 and connector 52 by way of a cord which extends through the opening between shelves 34 and 36 toward the rear so that it can connect with a wall connector that is located within the cabinet. Alternatively, an extension cord 54 can be provided for convenient external connection when there is no wall plug within the cabinet. So as to provide storage room for extension cord 54, cleats 56 and 58 are located on supports 38 and 39, respectively. Thus, cord 54 can be wound thereabout in the manner shown. It is convenient to recess supports 38 and 39 from side edge 60 of shelf 36 to provide adequate space for the extension cord when apparatus 10 is put away within cabinet 12.

It should be noted that shelf 36 is sufficiently low in height so as to permit it to be installed underneath the drain of the lavatory included within cabinet 12, or, alternatively, to be shortened or notched at its rear edge to fit around such drain and water pipes connected to the lavatory basin.

To install assembly 29, two or more screw holes 62 and 64 are provided in platform 18 to accept woodscrews. Thus, with only two or preferably four woodscrews, platform 18 may be secured to the bottom floor of cabinet 12.

As a safety feature, a spring-loaded cut-off switch 66 can be provided in front panel 46, which switch is activated after apparatus 10 is put away within cabinet 12 and cabinet door 14 is closed. Alternatively, a timer 61 can be provided (that is turned on either manually or automatically at the beginning of the use of the apparatus) and carried on one of the shelves of caddy apparatus 10. Apparatus 10 is shown in a construction that is conventiently made out of wood; however, alternatively it can be made from hard plastic in one or more pieces, if desired.

While a particular embodiment has been shown it will be understood that the invention is not limited thereto. Many modifications may be made that will become apparent to those skilled in the art.

What is claimed is:

1. In combination with a cabinet located underneath a bathroom lavatory, an electrical appliance-accommodating apparatus, comprising a base for fitting within a cabinet and including at least two screw holes to permit said base to be firmly secured by the use of wood screws therethrough to the floor of the cabinet, a sliding support assembly having a lower horizontal shelf having electrical power connecting means for connection to a plurality of appliances carried by said support assembly by connection to their respective electrical cords, said lower shelf also accommodating the coiling of electrical appliance cords of a plurality of appliances carried by said support assembly, input connection means carried by said assembly for connection inside the cabinet or outside the cabinet when the cabinet door is open, an upper horizontal shelf for supporting at least a first electrical appliance, said upper shelf being recessed at its front end to permit at least a second electrical appliance to be accommodated on said lower shelf in front of said upper shelf, and sliding means, attached to said base and said support assembly to permit said support assembly to be extended from said cabinet to allow access to a first electrical appliance located on said upper shelf and a second electrical appliance located on said lower shelf.

2. An electrical appliance-accommodating apparatus in accordance with claim 1, wherein said sliding means includes a first portion and a second portion, said first portion being slidably interengaged with said second portion, said base includes horizontal side pieces to which said first portion of said sliding means is attached, and said support assembly attaches to said second portion of said sliding means.

3. An electrical appliance-accommodating apparatus in accordance with claim 1, wherein said upper shelf includes holes through which appliance cords can pass.

4. An electrical appliance-accommodating apparatus in accordance with claim 1, wherein said upper shelf is supported by at least one side support piece that is recessed with respect to said upper shelf and includes means for storing a coiled extension cord.

5. An electrical appliance-accommodating apparatus in accordance with claim 1, wherein said support assembly includes switch means operated closed when said support assembly is slid into the cabinet and the door of the cabinet is closed.

6. An electrical appliance-accommodating apparatus in accordance with claim 1, wherein said power connecting means includes timing means for automatically turning off power to appliances carried by said support assembly after a period of time following power turn on.

7. An electrical appliance-accommodating apparatus in accordance with claim 1, and including cup-shaped receptacle means on said upper shelf for receiving small items.

8. An electrical appliance-accommodating apparatus in accordance with claim 1, wherein said sliding support assembly is molded plastic.

* * * * *